US006544702B1

(12) United States Patent
Haggquist et al.

(10) Patent No.: US 6,544,702 B1
(45) Date of Patent: Apr. 8, 2003

(54) CHARGE TRANSPORT LAYERS COMPRISING HYDRAZONES AND PHOTOCONDUCTORS INCLUDING THE SAME

(75) Inventors: Gregory Walter Haggquist, Longmont, CO (US); Ronald Harold Levin, Boulder, CO (US); Scott Thomas Mosier, Boulder, CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/237,880

(22) Filed: Jan. 27, 1999

(51) Int. Cl.[7] ..... G03G 15/02

(52) U.S. Cl. ..... 430/58.4; 430/58.45; 430/58.5; 430/59.1; 430/83; 430/970

(58) Field of Search ..... 430/58.4, 58.45, 430/58.5, 59.1, 83, 970

(56) References Cited

U.S. PATENT DOCUMENTS

| | | | | |
|---|---|---|---|---|
| 4,362,798 A | | 12/1982 | Anderson et al. | 430/83 |
| 4,563,408 A | | 1/1986 | Lin et al. | 430/58.4 |
| 4,677,045 A | * | 6/1987 | Champ et al. | 430/76 |
| 4,888,262 A | | 12/1989 | Tamaki et al. | 430/66 |
| 4,943,501 A | | 7/1990 | Kinoshita et al. | 430/60 |
| 5,292,603 A | | 3/1994 | Sakai et al. | 430/18 |
| 5,308,727 A | | 5/1994 | Osawa et al. | 430/60 |
| 5,380,613 A | | 1/1995 | Ueda et al. | 430/60 |
| 5,474,868 A | | 12/1995 | Adachi et al. | 430/83 |
| 5,618,646 A | * | 4/1997 | Nogami et al. | 430/58.45 |
| 5,670,284 A | | 9/1997 | Kishi et al. | 430/60 |
| 5,707,766 A | | 1/1998 | Nogami et al. | 430/83 |
| 5,721,081 A | | 2/1998 | Takagi et al. | 430/58.45 |

FOREIGN PATENT DOCUMENTS

| | | | |
|---|---|---|---|
| EP | 0413338 | | 8/1990 |
| JP | 58-163946 | * | 9/1983 |

OTHER PUBLICATIONS

English Translation of JP 58–163,946, Sep. 28, 1983.*
Derwent Abstract Acc. No. 1983–810520 of JP 58–163946 (Pub Sep. 1983).*
Caplus Abstract AN 1984:112233 of JP 58–163946 (Pub Sep. 1983).*
ACS Registry No. 10343–55–2, copyright 1999.*
ACS Registry No. 12239–75–7, copyright 1999.*
ACS Registry No. 12237–31–9, copyright 1999.*
Mizuta et al, Mita Ind. Co., Ltd., Mechanism of Photo–induced Fatigue Phenomenon of Monolayer Organic Photoconductor Using Carbazole Hydrazone Derivative as Charge Transport Material, pp. 663–666 (1997) month not known.
Nakazawa et al, Mita Ind. Co., Ltd., A New type of Monolayered Organic Photoconductor for Positively–Charging Xerography–Chemistry and Characteristics (1992) month not known.

(List continued on next page.)

*Primary Examiner*—Mark A. Chapman
(74) *Attorney, Agent, or Firm*—John A. Brady

(57) ABSTRACT

Charge transport layers comprise a hydrazone charge transport compound, Savinyl® yellow and an antioxidant. Dual layer photoconductors comprise the charge transport layer in combination with a substrate and a charge generation layer.

28 Claims, 1 Drawing Sheet

OTHER PUBLICATIONS

Figure 1:
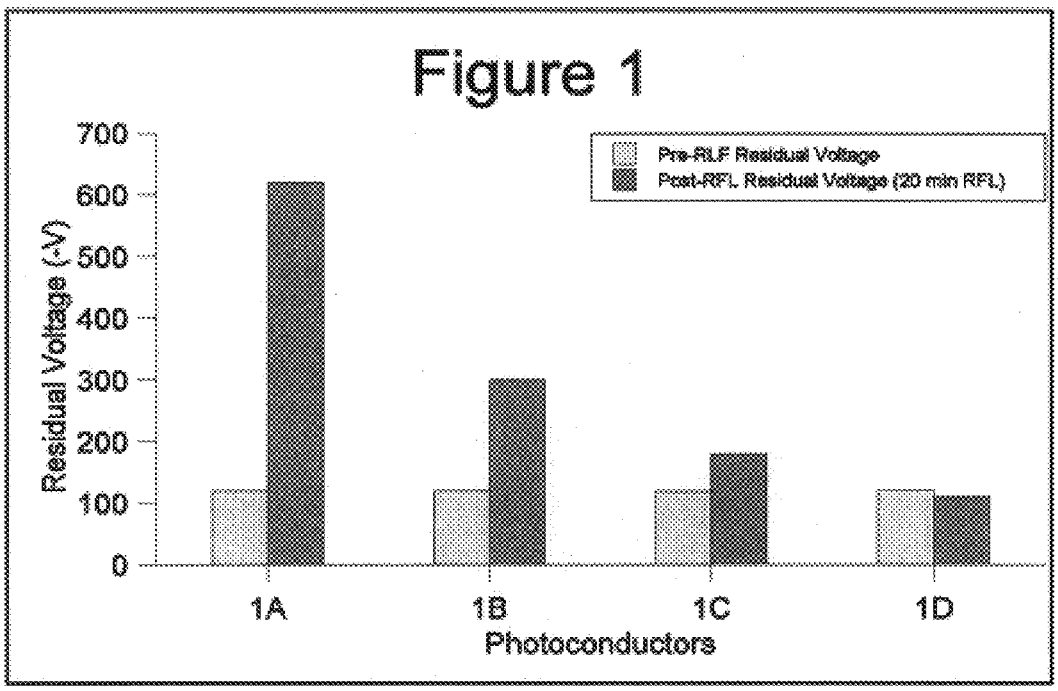

Matsuda et al, The Chemical Society of Japan, *Chemistry Letters,* Photochemical Conversion of Anti–9–Methylcarbazole–3–Carbaldehyde, pp. 1129–1132 (1992).

Nakazawa et al, The Chemical Society of Japan, *Chemistry Letters,* Anti–Syn Isomerization of Carbazole–3–Carbaldehyde Hydrazone Derivative, pp. 1125–1128 (1992).

Chemical Abstract Registry No. 92091–43–5 copyright 1998 ACS.

Chemical Abstract Registry No. 61901–95–9 copyright 1998 ACS.

Chemical Abstract Registry No. 61116–27–6 copyright 1998 ACS.

Savinyl Yellow 5GLS Material Safety Data Sheet, Sandoz Chemicals (1986).

Acetesol Yellow, Boulder Scientific Company (1986).

Mizuta et al, *Chem. Funct. Dyes,* Proc. Int. Symp. 2nd, Photoisomerization of Aromatic Hydrazone and its Contribution to the Photoinduced Fatigue Phenomenon of Organic Photoconductor, pp. 628–631 (1992).

* cited by examiner

Pre-RLF Residual Voltage
Post-RFL Residual Voltage (20 min RFL)
Residual Voltage (-V)
700
600
500
400
300
200
100
0
1A
1B
1C
1D
Photoconductors

CHARGE TRANSPORT LAYERS COMPRISING HYDRAZONES AND PHOTOCONDUCTORS INCLUDING THE SAME

FIELD OF THE INVENTION

The present invention is directed to charge transport layers which comprise a hydrazone charge transport compound, and which further comprise Savinyl® yellow and an antioxidant. The invention is also directed to photoconductors including such charge transport layers.

BACKGROUND OF THE INVENTION

In electrophotography, a latent image is created on the surface of an imaging member which is a photoconducting material by first uniformly charging the surface and selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on the relative electrostatic charges on the photoconductor surface, the development electrode and the toner.

Typically, a dual layer electrophotographic photoconductor comprises a substrate such as a metal ground plane member on which a charge generation layer (CGL) and a charge transport layer (CTL) are coated. The charge transport layer contains a charge transport material which comprises a hole transport material or an electron transport material. For simplicity, the following discussions herein are directed to the use of charge transport layer which comprises a hole transport material as the charge transport compound. One skilled in the art will appreciate that if the charge transport layer contains an electron transport material rather than a hole transport material, the charge placed on the photoconductor surface will be opposite that described herein.

When the charge transport layer containing a hole transport material is formed on the charge generation layer, a negative charge is typically placed on the photoconductor surface. Conversely, when the charge generation layer is formed on the charge transport layer, a positive charge is typically placed on the photoconductor surface. Conventionally, the charge generation layer comprises the charge generation compound or molecule alone and/or in combination with a binder. The charge transport layer typically comprises a polymeric binder containing the charge transport compound or molecule. The charge generation compounds within the charge generation layer are sensitive to image-forming radiation and photogenerate electron hole pairs therein as a result of absorbing such radiation. The charge transport layer is usually non-absorbent of the image-forming radiation and the charge transport compounds serve to transport holes to the surface of a negatively charge photoconductor. Photoconductors of this type are disclosed in the Adley et al U.S. Pat. No. 5,130,215 and the Balthis et al U.S. Pat. No. 5,545,499.

The Anderson et al U.S. Pat. No. 4,150,987 discloses a layered electrophotographic plate or element having a conventional charge generation layer and a charge transport layer containing p-type hydrazone. While the Anderson et al photoconductor is particularly good for use in electrophotography processes, it has been found that prolonged exposure to ambient light, and particularly to cool-white fluorescent light usually found in offices, may decrease the photosensitivity of the photoconductor. This is commonly referred to in the art as room light fatigue (RLF). Exposure of such photoconductors to cool-white ambient fluorescent lighting, even for just a few minutes, results in a significant shift in the residual voltage, commonly referred to as fatigue. This shift in residual potential means that factors such as print density and background density will be different on a print made from the fatigued drum when compared to the last print made before fatiguing this drum. Hence, when a machine is opened for the slightest reason, for example to clear a paper jam, ambient fluorescent light can enter and damage the photoconductor.

Typically, room light fatigue does not occur in high speed duplicators, since experienced, well-trained operators commonly service such devices and do not expose the photoconductor to ambient light for prolonged periods. However, room light fatigue typically occurs in low speed copiers since such copiers are often attended by operators having little or no training.

A number of experiments have suggested that room light fatigue is caused by a hydrazone transport compound undergoing syn-anti isomerization about the hydrazone C=N double bond. The preferred hydrazone molecule, p-diethylaminobenzaldehyde-(diphenylhydrazone) (DEH), represented by the structural formula (I), has been found to experience an undesirable change in light sensitivity when exposed to conventional cool-white fluorescent room light for 15 minutes or more.

(I)

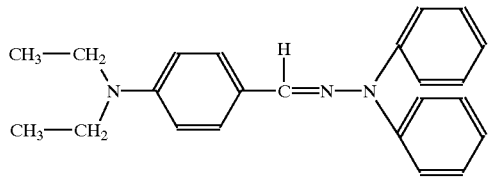

The suggestion of a syn-anti isomerization has led to various approaches in the art to prevent this isomerization. One of the first approaches was the "sunblock" approach as disclosed by Nakasawa et al, Japanese Patent Reference No. 63-271453. Just as a sunscreen retards light absorption by human skin pigments, it was suggested that incorporating a molecule that absorbs at the cool-white fluorescent wavelength would prevent this isomerization. However, large amounts of the light-absorbing molecule were typically required in order to absorb most of the damaging radiation and resulted in a marked decrease in photosensitivity as charge generation molecule (CGM) and charge transport molecule (CTM) concentrations were correspondingly reduced. Hence, this was not a viable approach to an RLF-protected, yet fully functional, photoconductor.

Additional studies in the art have involved the addition of a molecule that could quench the excited singlet state of the hydrazone CTM, thereby preventing the syn-anti photoisomerization which retards RLF. The Maeda et al European Patent Publication No. 041338A1 discloses that addition of a fluorenone derivative compound at a 1–5% level has afforded some RLF protection, while not compromising electrical performance.

However, a need remains for hydrazone-containing photoconductors which exhibit reduced room light fatigue.

SUMMARY OF THE INVENTION

Accordingly, it is the object of the present invention to provide novel charge transport layers which overcome disadvantages of the prior art. It is a more specific object of the invention to provide charge transport layers which reduce or eliminate the room light fatigue exhibited in conventional hydrazone-containing organic photoconductors.

These and additional objects are provided by charge transport layers and photoconductors of the present invention. The charge transport layers comprise a hydrazone charge transport compound, Savinyl® yellow and an ester-containing antioxidant. In one embodiment of the invention, the antioxidant comprises octadecyl 3-(3,5-di-tert-butyl-4-hydroxyphenyl) proprionate or pentaerythritol tetrakis (3,5-di-tert-butyl-4-hydroxy hydrocinnamate). The photoconductors comprise a substrate, a charge generation layer, and a charge transport layer, wherein the charge transport layer comprises a hydrazone charge transport compound, Savinyl® yellow, and an ester-containing antioxidant.

The charge transport layers according to the present invention surprisingly reduce or eliminate the room light fatigue exhibited by conventional hydrazone based organic photoconductors. While not being limited by theory, it is believed that the charge transport layers containing the hydrazone charge transport compound, the Savinyl® yellow and an ester-containing antioxidant in combination preclude the undesired syn-anti photoisomerization of the hydrazone charge transport compound, and therefore substantially eliminate room light fatigue. These and additional objects and advantages will be more readily apparent in view of the following detailed description.

DETAILED DESCRIPTION

The charge transport layers according to the present invention are suitable for use in dual layer photoconductors. Such photoconductors generally comprise a substrate, a charge generation layer and a charge transport layer. While various embodiments of the invention discussed herein refer to the charge generation layer as being formed on the substrate, with the charge transport layer formed on the charge generation layer, it is equally within the scope of the present invention for the charge transport layer to be formed on the substrate with the charge generation layer formed on the charge transport layer. In other words, the charge generation layer according to the present invention can be arranged between the charge transport layer and the substrate or, in another embodiment, the charge transport layer can be arranged between the charge generation layer and the substrate.

The present invention is directed towards charge transport layers containing a hydrazone charge transport compound, Savinyl® yellow and an ester-containing based antioxidant. In addition, the charge transport layers of the present invention may also comprise a binder. Typically, the binder is polymeric and may comprise, but is not limited to, vinyl polymers such as polyvinyl chloride, polyvinyl butyral, polyvinyl acetate, styrene polymers, and copolymers of these vinyl polymers, acrylic acid and acrylate polymers and copolymers, polycarbonate polymers and copolymers, including polycarbonate-A, which is derived from bisphenol A, polycarbonate-Z, which is derived from cyclohexylidene bisphenol, polycarbonate-C, which is derived from methyl bisphenol A, polyester carbonates, polyesters, alkyd resins, polyamides, polyurethanes, epoxy resins, or copolymers thereof or mixtures thereof and the like. Preferably, the polymeric binder of the charge transport layer is inactive, i.e., it does not exhibit charge transport properties.

Any hydrazone compound exhibiting charge transport properties may be employed in the charge transport layers of the invention. Suitable hydrazone charge transport molecules include, but are not limited to, p-diethylaminobenzaldehyde-(diphenylhydrazone), p-diphenylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example, in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example, in U.S. Pat. Nos. 4,385,106, 4,338,388, 4,387,147, 4,399,208 and 4,399,207. Yet other hydrazone charge transport molecules include carbazole phenyl hydrazones such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426. Preferred hydrazone transport molecules include derivatives of aminobenzaldehydes, cinnamic esters or hydroxylated benzaldehydes. Exemplary amino benzaldehyde-derived hydrazones include those set forth in the Anderson et al U.S. Pat. Nos. 4,150,987 and 4,362,798, while exemplary cinnamic ester-derived hydrazones and hydroxylated benzaldehyde-derived hydrazones are set forth in the copending Levin et al U.S. applications Ser. Nos. 08/988,600 and 08/988,791, respectively, all of which patents and applications are incorporated herein by reference.

In accordance with an important feature of the invention, the charge transport layer comprises the hydrazone charge transport molecule in combination with Savinyl® yellow and an ester-containing antioxidant. The present inventors have discovered that charge transport layers made from the combination of these compounds can substantially preclude room light fatigue of the photoconductor.

In accordance with an important feature of the invention, the charge transport layer comprises the hydrazone charge transport molecule in combination with Savinyl® yellow and an ester-containing antioxidant. The Savinyl® yellow used in the present invention is also known in the art as C.I. Solvent Yellow 138. Savinyl® yellow can be obtained under the tradename Savinyl® yellow 5GLS from Sandoz Chemicals or under the tradename ACETOSOL yellow from Boulder Scientific Company. For consistency and ease of understanding the present invention, Savinyl® yellow is used throughout the application, where one skilled in the art will recognize that the Savinyl® yellow reference is the same material as C.I. Solvent Yellow 138.

Several classes of materials commonly known as ester-containing antioxidants are known in the art and are suitable for use in the present invention. These materials may be substituted, unsubstituted, monomeric or polymeric and may perform multiple functions. The Lin et al U.S. Pat. No. 4,563,408 discloses typical antioxidants (i.e., materials which inhibit autooxidation, photooxidation and sensitized photooxidation) which include: (1) antioxidants for autooxidation (free radical inhibitors or quenchers or stabilizers) which can prevent or retard the autooxidation of organic material including aromatic diamine charge transport molecules, aromatic amine derivatives and hydrazone compounds; and (2) antioxidants for the inhibition of sensitized photooxidation involving singlet oxygen. The Tamaki et al U.S. Pat. No. 4,888,262 discloses ester-containing antioxidizing agents comprising hindered phenolics and organic sulfur compounds, and the Kinoshita et al U.S. Pat. No. 4,943,501 discloses exemplary compounds comprising hindered phenol structure units, all of which Lin et al, Tamaki et al and Kinoshita et al patents are incorporated herein by reference.

In a specific embodiment of the present invention, the ester-containing antioxidant comprises octadecyl 3-(3,5-di-tert-butyl-4 hydroxyphenyl) proprionate or pentaerythritol tetrakis (3,5-di-tert-butyl-4-hydroxyhydrocinnamate).

The charge transport layer typically comprises the Savinyl® yellow and the ester-containing antioxidant in a weight ratio of from about 1:20 to about 20:1, and more preferably in a weight ratio from about 1:10 to about 10:1, and even more preferably in a weight ratio of from about 1:5 to about 5:1. In further preferred embodiments, the weight ratio is from about 1:2 to about 4:1.

The charge transport layer typically comprises from about 1 to about 40 weight percent of Savinyl® yellow and the ester-containing antioxidant combined and from about 20 to about 60 weight percent of the hydrazone charge transport compound. More preferably, the charge transport layer comprises from about 1 to about 10 weight percent of Savinyl® yellow and the ester-containing antioxidant combined and from about 20 to about 60 weight percent of the hydrazone charge transport compound. In further preferred embodiments, the charge transport layer comprises from about 1 to about 5 weight percent of the Savinyl® yellow and ester-containing antioxidant combined and from about 20 to about 60 weight percent of the hydrazone charge transport compound.

In another embodiment, the charge transport layer comprises from about 1 to about 40 weight percent of Savinyl® yellow and the ester-containing antioxidant combined and from about 20 to about 60 weight percent of the hydrazone charge transport compound, with the remainder of the charge transport layer comprising the binder, and any conventional additives. More preferably, the charge transport layer comprises from about 1 to about 10 weight percent of Savinyl® yellow and the ester-containing antioxidant combined and from about 20 to about 60 weight percent of the hydrazone charge transport compound, with the remainder of the charge transport layer comprising the binder, and any conventional additives. In further preferred embodiments, the charge transport layer comprises from about 1 to about 5 weight percent of the Savinyl® yellow and ester-containing antioxidant combined and from about 20 to about 60 weight percent of the hydrazone charge transport compound, with the remainder of the charge transport layer comprising the binder, and any conventional additives.

The charge transport layer will typically have a thickness of from about 10 to about 40 microns and can be formed in accordance with conventional techniques known in the art.

Photoconductors according to the invention comprise a substrate, a charge transport layer as described and a charge generation layer. Any conventional charge generation layer may be employed. The charge generation layers according to the present invention typically comprise a binder and a charge generation compound. Various organic and inorganic charge generation compounds are known in the art, any of which are suitable for use in the charge generation layers of the present invention. One type of charge generation compound which is particularly suitable for use in the charge generation layers of the present invention comprises the squarylium-based pigments including squaraines. In particular, hydroxy-substituted squarylium pigments are suitable for use in the present invention. Squarylium pigment may be prepared by an acid route, for example, as described in U.S. Pat. Nos. 3,617,270, 3,824,099, 4,175,956, 4,486,520 and 4,508,803, which employs simple procedures and apparatus, has a short reaction time and high yield. The squarylium pigment is therefore very inexpensive and easily available.

Preferred squarylium pigments suitable for use in the present invention may be represented by the structural formula II wherein R, represents hydroxy, hydrogen or $C_1$–$C_5$ alkyl, aryl, preferably hydroxy, hydrogen or methyl, and each $R_2$ individually represents $C_1$–$C_5$ alkyl, aryl or hydrogen.

(II)

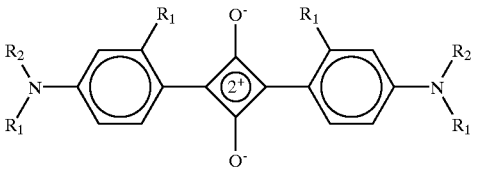

In a preferred embodiment, the pigment comprises a hydroxy squaraine pigment wherein each $R_1$ in the formula II set forth above comprises hydroxy.

The following example demonstrates various embodiments and advantages of the charge transport layers and photoconductors according to the present invention. In the example and throughout the present specification, parts and percentages are by weight unless otherwise indicated.

EXAMPLE

In this Example, photoconductors according to the present invention and comparative photoconductors were prepared using charge transport layers according to the present invention and conventional charge transport layers, respectively. Each of the photoconductors described in this example was prepared by dip-coating a charge generation layer dispersion on an aluminum substrate, followed by dip-coating a charge transport layer dispersion on the charge generation layer. In each of the photoconductors, the charge generation layer comprised about 35 weight percent hydroxy squaraine ((2,4-bis(4-dimethylamino-2-hydroxyphenyl) cyclobutenediylium-1,3-diolate)) (HOSQ) and about 65 weight percent polymeric binder.

The charge transport layers of the respective photoconductors according to this example comprised polymeric binder and charge transport compound. As described in Table 1, compositions 1B–1C contained additional additives, respectively. As will be apparent from Table 1, photoconductors 1A–1C are comparative photoconductors whereas photoconductor 1D is a photoconductor containing charge transport layers according to the present invention and comprising a hydrazone charge transport compound in combination with Savinyl® yellow and an ester-containing antioxidant.

TABLE 1

| Photo-conductor | Charge Transport Compound | Room Light Fatigue-Reducing Additive(s) |
|---|---|---|
| 1A | 40% DEH | None |
| 1B | 40% DEH | 3.5% dihydrocinnamate ester |
| 1C | 40% DEH | 1.0% Savinyl ® yellow |
| 1D | 40% DEH | 3.5% dihydrocinnamate ester and 1.0% Savinyl ® yellow |

The photoconductors of this example were subjected to measurement of residual voltage both before and after exposure to fluorescent room light for 20 minutes, and the results of these measurements are set forth in FIG. 1.

FIG. 1 demonstrates the surprising results exhibited by photoconductor 1D utilizing a combination of an ester-containing antioxidant and Savinyl® yellow in an otherwise standard hydrazone-containing charge transport layer. These photoconductors exhibited substantially total room light fatigue resistance during exposure for 20 minutes. In contrast, photoconductor 1B containing the antioxidant, in the absence of Savinyl® yellow, and photoconductor 1C, containing Savinyl® yellow, in the absence of the antioxidant, both exhibited significant room light fatigue. While not intending to be limited by theory, the inventors believe that this combination of Savinyl® yellow and ester antioxidant molecules serves to quench both the excited singlet and excited triplet states of the hydrazone charge transport molecule, thereby totally precluding the undesired syn-anti photoisomerization. The effectiveness of the room light fatigue additives as a singlet or triplet quencher is believed to be determined by the energy of the electronic excited states of the additives relative to the energy of the charge transport molecules in singlet and triplet excited states. In order to quench both the photoexcited charge transport molecule's singlet and triplet states, at least one of the additives must have an excited singlet state lower in energy than the charge transport molecule's excited singlet state. Additionally, at least one of the additives must have an excited triplet state lower in energy than the charge transport molecule's excited triplet state. Thus, in one embodiment the charge transport layer comprises a hydrazone charge transport compound and one or more additives wherein at least one of the additives has an excited singlet state lower in energy than an excited singlet state of the hydrazone charge transport molecule and at least one of the additives has an excited triplet state lower in energy than an excited triplet state of the hydrazone charge transport molecule.

The examples demonstrate that the photoconductors according to the present invention exhibit surprising results in the elimination of the room light fatigue that commonly occurs in the standard charge transport layer in photoconductors.

The various embodiments and examples set forth herein utilize an ester-containing antioxidant and Savinyl® yellow as the additives to further illustrate the claimed invention and are not intended to be limiting thereof. Additional additives and alternatives within the scope of the claimed invention as a singlet or triplet quencher will be apparent to those of ordinary skill in the art. The various preferred embodiments and examples set forth herein are presented in order to further illustrate the claimed invention and are not intended to be limiting thereof. Additional embodiments and alternatives within the scope of the claimed invention will be apparent to those of ordinary skill in the art.

We claim:

1. A charge transport layer, comprising a hydrazone charge transport compound, C.I. Solvent Yellow 138 and an ester-containing antioxidant.

2. A charge transport layer as defined by claim 1, wherein the ester-containing antioxidant comprises octadecyl 3-(3,5-di-tert-butyl-4-hydroxyphenyl) propionate or pentaerythritol tetrakis (3,5-di-tert-butyl-4-hydroxyhydrocinnamate).

3. A charge transport layer as defined by claim 2, comprising the C.I. Solvent Yellow 138 and the ester-containing antioxidant in a weight ratio of from about 1:5 to about 5:1.

4. A charge transport layer as defined by claim 2, comprising from about 1 to about 5 weight percent of C.I. Solvent Yellow 138 and the ester-containing antioxidant combined, and from about 20 to about 60 weight percent of the hydrazone charge transport compound.

5. A charge transport layer as defined by claim 1, comprising the C.I. Solvent Yellow 138 and the ester-containing antioxidant in a weight ratio of from about 1:20 to about 20:1.

6. A charge transport layer as defined by claim 1, comprising the C.I. Solvent Yellow 138 and the ester-containing antioxidant in weight ratio of from about 1:10 to about 10:1.

7. A charge transport layer as defined by claim 1, comprising the C.I. Solvent Yellow 138 and the ester-containing antioxidant in a weight ratio of from about 1:5 to about 5:1.

8. A charge transport layer as defined by claim 1, comprising from about 1 to about 40 weight percent of C.I. Solvent Yellow 138 and the ester-containing antioxidant combined, and from about 20 to about 60 weight percent of the hydrazone charge transport compound.

9. A charge transport layer as defined by claim 1, comprising from about 1 to about 10 weight percent of C.I. Solvent Yellow 138 and the ester-containing antioxidant combined, and from about 20 to about 60 weight percent of the hydrazone charge transport compound.

10. A charge transport layer as defined by claim 1, comprising from about 1 to about 5 weight percent of C.I. Solvent Yellow 138 and the ester-containing antioxidant combined, and from about 20 to 60 weight percent of the hydrazone charge transport compound.

11. A charge transport layer as defined by claim 1, further comprising a binder.

12. A charge transport layer as defined by claim 11, wherein the binder comprises polyvinyl chloride, polyvinylbutyral, polyvinyl acetate, styrene polymer, polycarbonate-A, polycarbonate-Z, polycarbonate-C, polyester carbonate, polyester, alkyd resin, polyamide, polyurethane, epoxy resin, or copolymers thereof, or mixtures thereof.

13. A photoconductor, comprising an electrically conductive substrate, a charge generation layer and a charge transport layer, wherein the charge transport layer comprises a hydrazone charge transport compound, C.I. Solvent Yellow 138 and an ester-containing antioxidant.

14. A photoconductor as defined by claim 13, wherein the ester-containing antioxidant comprises octadecyl 3-(3,5-di-tert-butyl-4-hydroxyphenyl) propionate or pentaerythritol tetrakis (3,5-di-tert-butyl-4-hydroxyhydrocinnamate).

15. A photoconductor as defined in claim 13, comprising the C.I. Solvent Yellow 138 and the ester-containing antioxidant in a weight ratio of from about 1:20 to about 20:1.

16. A photoconductor as defined by claim 13, comprising the C.I. Solvent Yellow 138 and the ester-containing antioxidant in a weight ratio of from about 1:5 to about 5:1.

17. A photoconductor as defined by claim 13, wherein the charge transport layer comprises from about 1 to about 40 weight percent of C.I. Solvent Yellow 138 and the ester-containing antioxidant combined and from about 20 to about 60 weight percent of the hydrazone charge transport compound.

18. A photoconductor as defined by claim 13, wherein the charge transport layer comprises from about 1 to about 10 weight percent of C.I. Solvent Yellow 138 and the ester-containing antioxidant combined, and from about 20 to about 60 weight percent of the hydrazone charge transport compound.

19. A photoconductor as defined by claim 13, wherein the charge transport layer comprises from about 1 to about 5 weight percent of C.I. Solvent Yellow 138 and the ester-containing antioxidant combined, and from about 20 to about 60 weight percent of the hydrazone charge transport compound.

20. A photoconductor as defined by claim 13, wherein the charge generation layer comprises a squarylium pigment charge generation compound.

21. A photoconductor as defined by claim 13, wherein the charge generation layer comprises a hydroxy-substituted squarylium pigment charge generation compound.

22. A photoconductor as defined by claim 13, wherein the charge generation layer is arranged between the charge transport layer and the substrate.

23. A photoconductor as defined by claim 13, wherein the charge transport layer is arranged between the charge generation layer and the substrate.

24. A photoconductor as defined by claim 13, wherein the charge transport layer comprises a binder.

25. A photoconductor as defined by claim 24, wherein the binder comprises polyvinyl chloride, polyvinylbutyral, polyvinyl acetate, styrene polymer, polycarbonate-A, polycarbonate-Z, polycarbonate-C, polyester carbonate, polyester, alkyd resin, polyamide, polyurethane, epoxy resin, or copolymers thereof, or mixtures thereof.

26. A photoconductor, comprising an electrically conductive substrate, a charge generation layer and a charge transport layer, wherein the charge transport layer comprises from about 20 to about 60 weight percent of a hydrazone charge transport compound and from about 1 to about 5 weight percent of C.I. Solvent Yellow 138 and an ester-containing antioxidant combined, wherein the C.I. Solvent Yellow 138 and the ester-containing antioxidant are present in a weight ratio of from about 1:5 to about 5:1 and the ester-containing antioxidant comprises octadecyl 3-(3,5-di-tert-butyl-4-hydroxyphenyl) propionate or pentaerythritol tetrakis (3,5-di-tert-butyl-4-hydroxyhydrocinnamate).

27. A charge transport layer, comprising a hydrazone charge transport compound, from about 1 to about 10 weight percent of C.I. Solvent Yellow 138 and a hindered phenol ester-containing antioxidant combined, wherein the C.I. Solvent Yellow 138 and the hindered phenol ester-containing antioxidant are present in a weight ratio of from about 1:20 to about 20:1.

28. A photoconductor comprising an electrically conductive substrate, a charge generation layer and a charge transport layer, wherein the charge generation layer comprises a squarylium pigment charge generation compound, wherein the charge transport layer comprises a hydrazone charge transport compound, from about 1 to about 10 weight percent of C.I. Solvent Yellow 138 and a hindered phenol ester-containing antioxidant combined, and wherein the C.I. Solvent Yellow 138 and the hindered phenol ester-containing antioxidant are in a weight ratio of from about 1:20 to about 20:1.

* * * * *

UNITED STATES PATENT AND TRADEMARK OFFICE

CERTIFICATE OF CORRECTION

PATENT NO. : 6,544,702 B1
DATED : April 8, 2003
INVENTOR(S) : Haggquist et al.

It is certified that error appears in the above-identified patent and that said Letters Patent is hereby corrected as shown below:

Title page,
Item [*] Notice, add:
-- Subject to any disclaimer, the term of this patent is extended or adjusted under 35 U.S.C. 154(b) by 247 days. --

Signed and Sealed this

Twenty-sixth Day of July, 2005

JON W. DUDAS
*Director of the United States Patent and Trademark Office*